United States Patent [19]

Morrison et al.

[11] 4,094,506

[45] June 13, 1978

[54] COMPETITIVE GAME

[75] Inventors: Howard J. Morrison, Deerfield; Alan A. Hicks, Chicago, both of Ill.

[73] Assignee: Marvin Glass & Associates, Chicago, Ill.

[21] Appl. No.: 799,706

[22] Filed: May 23, 1977

[51] Int. Cl.[2] ..... A63F 7/06; A63F 7/10; A63F 9/00

[52] U.S. Cl. ..... 273/85 R; 273/108; 273/119 R; 273/128 R; 273/129 E

[58] Field of Search ..... 273/85 R, 85 A, 85 E, 273/108, 118 R, 118 A, 118 D, 119 B, 119 A, 126 R, 126 A, 128 R, 128 A, 129 R, 129 E

[56] References Cited

U.S. PATENT DOCUMENTS

| | | | |
|---|---|---|---|
| 2,160,299 | 5/1939 | Zinngrabe | 273/85 R |
| 3,214,171 | 10/1965 | Luchsinger | 273/85 R UX |
| 3,559,991 | 2/1971 | Immendorf | 273/85 A |
| 3,827,691 | 8/1974 | Benander | 273/85 R |

FOREIGN PATENT DOCUMENTS

| | | | |
|---|---|---|---|
| 277,470 | 9/1927 | United Kingdom | 273/85 R |

*Primary Examiner*—Paul E. Shapiro

*Attorney, Agent, or Firm*—Mason, Kolehmainen, Rathburn & Wyss

[57] ABSTRACT

A competitive action game includes a generally horizontal playing surface mounted below a parallel cover sheet of resilient, transparent material. A plurality of deformable support columns flexibly maintain the cover at a preselected distance above the playing surface. The support columns may be deformed upon manual compression by a player to flex the surrounding portion of the cover toward the playing surface thus reducing the distance therebetween. The game apparatus includes a rolling supported playing object for positioning between the playing surface and the cover member such that, upon compression of a support column, the reduction of the space between the playing surface and the cover forces the playing object generally away from the point of pressure and in a predetermined direction.

19 Claims, 5 Drawing Figures

COMPETITIVE GAME

BACKGROUND OF THE INVENTION

A. Field of the Invention

The present invention relates to a new and improved competitive game apparatus employing a rolling supported playing object.

B. Description of the Prior Art

As a result of the increase in the interest in sports and sporting activities, games that resemble the action of these sports and sporting activities are becoming increasingly popular. To provide a game that is played substantially similar to a particular activity is difficult, however, in that reproduction of the players or participants and the involved playing field and equipment results in an expensive and complex game apparatus. Consequently, it is desirable to simulate various activities with a game apparatus while at the same time reducing the complexity of the manner of playing the game and the equipment required.

SUMMARY OF THE INVENTION

The present invention is directed to a new and improved game apparatus, the action of which resembles the sport of hockey. The game apparatus includes a playing field defining goals at opposite ends. A cover member is mounted by a peripheral wall and supported in a position at a preselected distance above the playing surface. The cover is preferably transparent and slightly flexible allowing the players to observe the playing field and the area between the playing field and the cover.

The cover is supported by a plurality of support columns made of deformable material such as urethane foam. These support columns serve to maintain the cover at a preselected distance above the playing surface and, in addition, may be compressed or deformed upon application of pressure by the players of the game to flex the cover and vary the distance between the cover and the playing surface. This compression or movement provides a propelling force to be imparted to a rolling object positioned on the playing field between the cover and the playing surface.

The rolling object preferably includes a pair of vertically stacked roller bearings within a holder. The holder is of a vertical height substantially equal to the preselected distance between the cover and the playing surface such that the peripheries of the roller bearings engage one of the surfaces. With this configuration of the roller element, upon compression of one of the support columns, the roller element will be forced away from the point of pressure due to the decreasing distance between the cover and the playing surface and the inflexibility of the holder. This action causes the roller element to be propelled in a preselected direction across the playing field and, preferably, toward one of the goals.

The game apparatus is designed to be played by two players and the goals and support columns may be designated in a manner such that each player, under the rules of the game, may be allowed to compress only certain support columns.

BRIEF DESCRIPTION OF THE DRAWINGS

The above and other objects and advantages and novel features of the present invention will become apparent from the following detailed description of a preferred embodiment of the invention illustrated in the accompanying drawings, wherein.

DESCRIPTION OF THE PREFERRED EMBODIMENT

Figure 1:
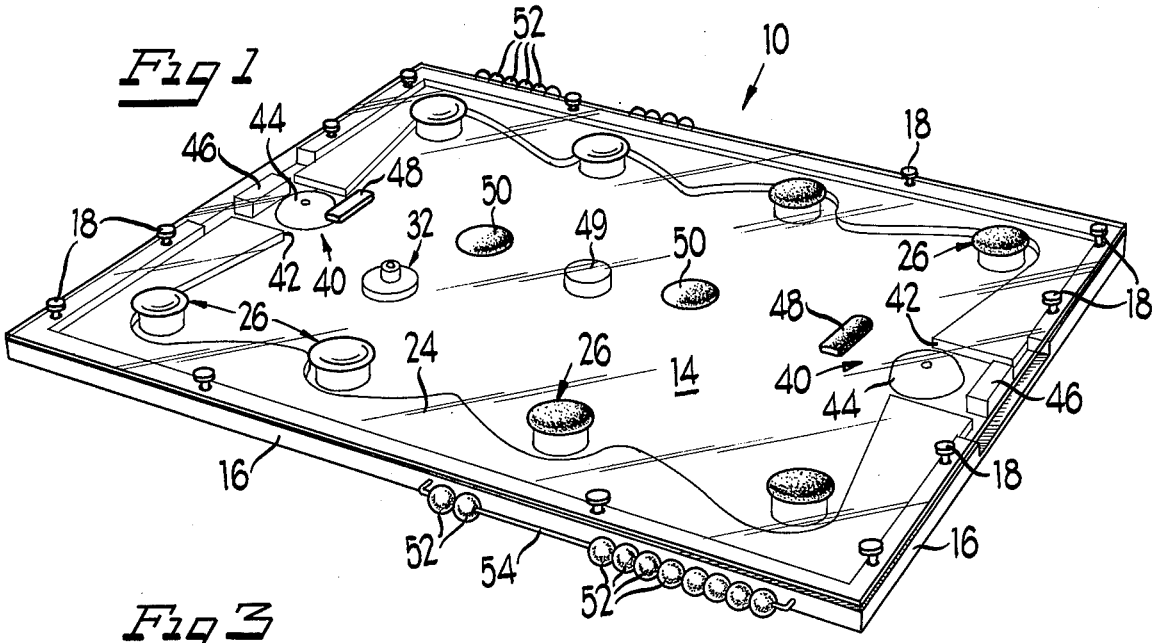
FIG. 1 is a perspective view of a preferred embodiment of a game apparatus constructed in accordance with the principles of the present invention.
Figure 3:
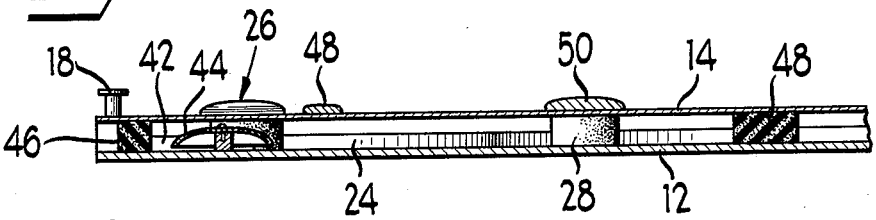
FIG. 3 is a fragmented vertical cross-sectional view taken along line 3—3 of FIG. 2.
Figure 4:
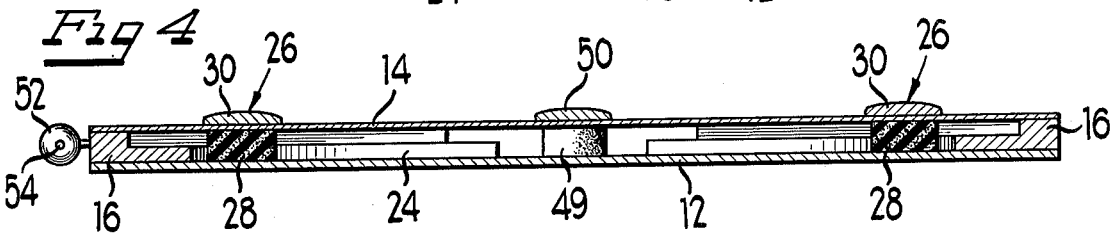
FIG. 4 is another vertical cross-sectional view taken along line 4—4 of FIG. 2.

With reference to the drawings, there is illustrated a new and improved game apparatus, generally designated by the reference numeral 10. The game apparatus 10 is similar in certain respects to the game of hockey in which the object of the game is to shoot or force a puck or playing piece into a goal.

The game apparatus 10 includes a planar playing surface 12 that in the preferred embodiment is of a rectangular configuration. A flexible transparent cover 14 is mounted above and spaced from the playing surface 12 allowing the players to observe the playing surface and the space therebetween.

Figure 5:
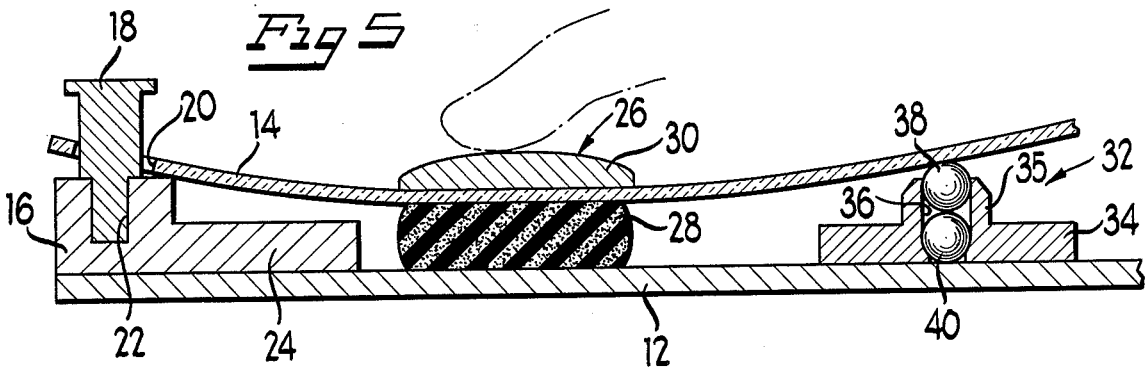
FIG. 5 is an enlarged cross-sectional view of a portion of the game apparatus showing the flexible nature of the cover.
Figure 2:
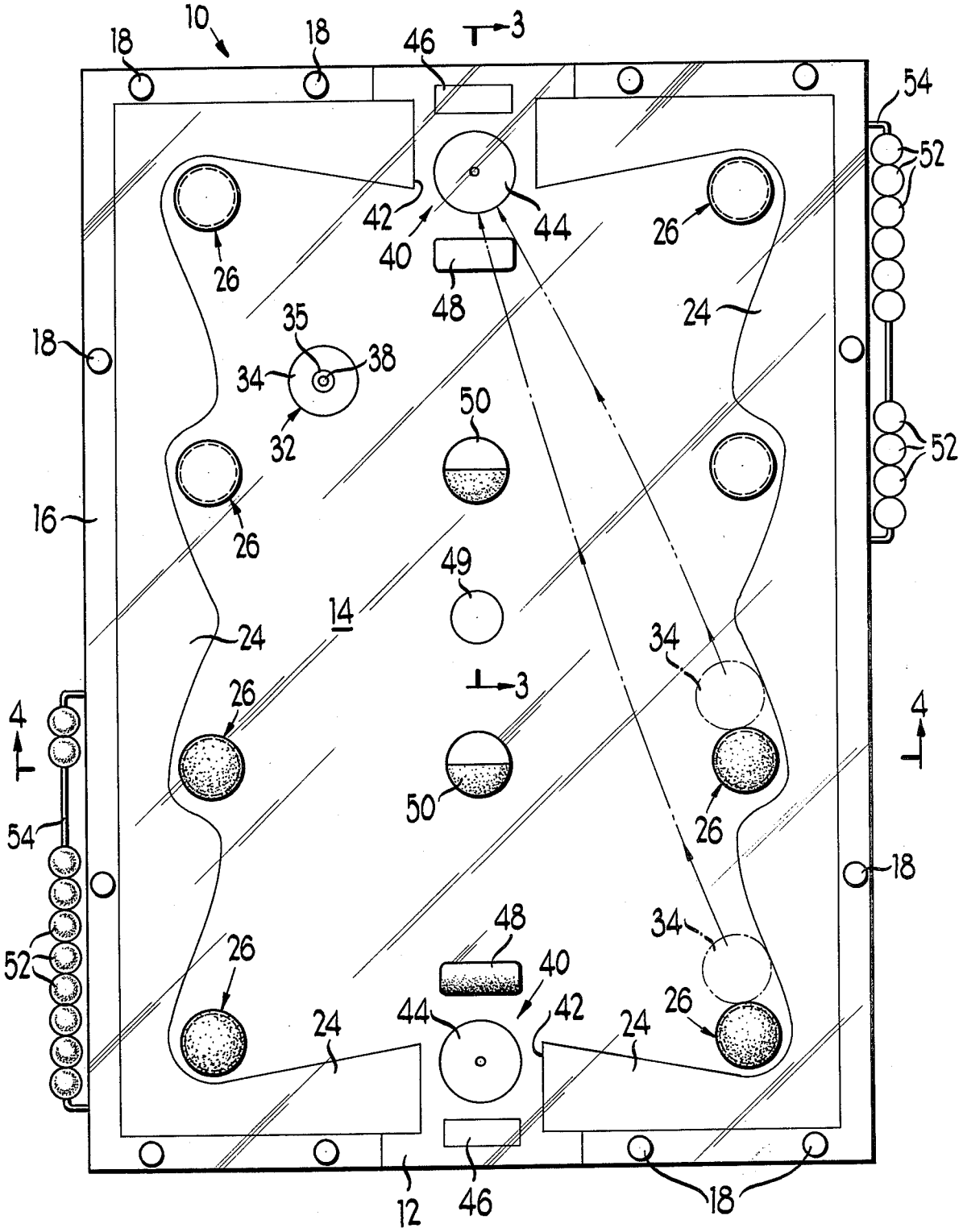
FIG. 2 is an enlarged top elevation view of the game apparatus illustrated in FIG. 1.

The cover 14 is attached to and spaced from the playing surface 12 at the edges thereof by being secured to a wall 16 around the periphery of the playing surface 12. The cover 14 is flexibly secured to the wall 16 by pegs 18 which extend through apertures 20 in the cover 14 and into suitable apertures 22 defined in the wall 16 (FIG. 5). The apertures 20 are of a dimension slightly larger than the diameter of the peg 18 to permit the cover 14 to be flexed thereby allowing movement of the cover 14 relative to the peg 18 providing substantially unhampered flexibility.

There may also be secured to the wall 16 or defined integrally therewith, a border portion 24 that extends outwardly from the wall 16 and onto the playing surface 12 to define out-of-bounds or border of the playing surface 12. This border portion 24 may be of any desired configuration or may be completely eliminated.

The cover 14 is supported above and spaced from the playing surface by a plurality of flexible columns 26. Each column 26 includes a base member 28 that is positioned between the playing surface 12 and the cover 14. The base member 28 may be secured to the playing surface 12 and the cover member 14 by adhesive material or other means of fastening. To be flexible, the member 28 may be fabricated from a material such as urethane foam.

An actuator or disc 30 is secured to the upper surface of the cover 14 directly above each of the column portions 28. The discs 30 may be of a more rigid material than the urethane foam that defines the base column 28.

The rigidity of the material defining the discs 30 serve to allow the players of the game apparatus 10 to manually apply compressive pressure to the columns 28 by a finger. This compressive force is transmitted through the playing surface 14 to the foam column portion 28 causing a compression thereof. Due to the flexibility of the cover 14, this compression of the support column 26 moves the cover 14 toward the playing surface 12 in the general vicinity of the point of compressive pressure thereby altering the distance between the cover 14 and playing surface 12 as shown in FIG. 5. This action provides the motive force to propel a playing piece or puck in the game apparatus 10.

The puck is defined by a rolling object, generally designated by the reference numeral 32. The rolling object 32 includes a disc-shaped holder 34 (FIG. 5) which includes a vertically extending hub portion 35. The vertical height of the hub 35 is less than the distance between the unflexed cover 14 and the playing surface 12. The holder 34 includes an axial bore 36 extending through the hub portion thereof. A pair of ball bearings 38 and 40 are rotatably positioned within the bore 36 in a vertically stacked arrangement such that the outer periphery of the bearing 38 engages the cover 14 and the outer periphery of the bearing 40 engages the playing surface 12. The low friction engagement of the bearings 38 and 40 with the surfaces 14 and 12, respectively, permits relatively frictionless rolling of the puck 32 between the surfaces 12 and 14.

A support column 26 close to the rolling object 34 may be compressed to propel the rolling member 32 across the playing surface 12. This action tends to reduce the distance between the cover 14 and the playing surface 12 as shown in FIG. 5. The reduction of the distance between the surfaces 12 and 14 and the angle or arc imparted to the cover 14 emanating from the point of pressure (FIG. 5) tends to force or propel the puck 32 away from the point of pressure and across the playing surface 12. Accordingly, a player may compress a selected column 26 thereby propelling the rolling object toward a goal.

There are two goals defined in the game apparatus 10 as illustrated. The goals are generally designated by the reference numeral 40. The goals 40 are defined by an opening 42 in the edge member 24. A goal is scored by propelling the rolling object 32 into the goal 40.

In the preferred embodiment illustrated, a bell 44 is positioned within the opening 42. If the rolling object 32 is propelled into the goal 42 it engages the bell 44 causing a ringing sound, indicating that a goal has been scored. The rear portion of the opening 42 may be blocked by a barrier 46 to prevent the introduction of objects into the goal area 42 from behind the bell 44.

In addition, a pad 48 may be secured to the cover 14 by adhesive material or the like directly in front of each goal 40. The pads 48 may be of different colors so as to indicate which goal each individual player has been assigned. This employment of distinguishing characteristics, such as color, may also be used to designate which of the support columns 26 may be compressed by the individual player. For example, if one player is designated a given color, such as red, certain of the support columns 26 may be so designated and only these support columns may be compressed by the particular player. The remaining support columns would correspond to the color of the opposing player and only those support columns could be compressed by the opposing player.

To add further support and to prevent damage to the cover 14, another support 49 may be employed at the approximate center of the playing surface 12. The central support 49 may be less flexible to provide support to the cover 14 and preventing over-flexing of the cover 14. The game apparatus 10 may also include two oppositely opposed pressure discs 50 secured to the upper surface of the cover 14 and on opposite sides of the support 49. The discs 50, due to their position relative to the column support 49, need not have a foam base column member positioned between the cover 14 and the playing surface 12 similar to the column portions 28. The discs 50 provide additional positions from which the rolling object 32 may be propelled. In the preferred embodiment illustrated, the discs 50 are colored half with one color and half with a second color to designate that each may be compressed by either player further adding to the enjoyment of the game apparatus 10.

To maintain an account as to the score, scoring beads, generally designated by the reference numeral 52, may be included. The scoring beads 52 are mounted on a wire or rail 54 that is secured to the wall 16. As a score is made by a particular player, a scoring bead 52 may be moved to one end of the wire 54 or the other designating a goal scored. Further, once a goal has been scored, a magnet or similar device may be placed on the cover 14 above the rolling object 32, and the object may be returned to the center line of the playing surface 12 in position ready to restart the game by manipulation of the magnet.

Many modifications and variations of the present invention are possible in light of the above teachings. Thus, it is to be understood that within the scope of the appended claims, the invention may be practiced otherwise other than specifically described above.

What is claimed and sought to be secured by Letters Patent of the United States is:

1. A game apparatus comprising:

means for defining a relatively flat playing surface;

flexible cover means spaced above said playing surface and deflectable downwardly;

resilient support means for normally supporting said cover means at a preselected spacing above said playing surface and compressible to provide reduced spacing between said cover means and said playing surface on downward deflection of said cover means; and a playing piece mounted for movement over said playing surface between said playing surface and said flexible cover means, said piece including means engageable by said cover means when deflected downwardly for propelling said piece across said playing surface in a direction determined by the deflection of said cover means.

2. The game apparatus of claim 1 wherein said playing surface is substantially rigid.

3. The game apparatus of claim 1 wherein said cover means is formed of transparent material.

4. The game apparatus of claim 1 including actuator means on said cover means above said support means for manually deflecting the cover means downwardly.

5. The game apparatus of claim 1 wherein said playing surface defines a scoring area for said playing piece.

6. The game apparatus of claim 1 wherein said playing piece comprises a pair of roller bearings, and a holder for said bearings, said bearings being vertically stacked in said holder with the periphery of each bearing engaging one of said playing surface and said cover means.

7. The game apparatus of claim 1 wherein said support means includes a plurality of flexible support columns mounted at spaced apart locations on the playing surface permitting localized deflection of said cover means for propelling said playing piece.

8. The game apparatus of claim 7 wherein said actuator means comprises a plurality of discs, one positioned above each of said support columns.

9. The game apparatus of claim 8 wherein said discs are provided with indicia thereon representing that a particular player may use the disc for compressing the cover means to propel the playing piece.

10. The game apparatus of claim 8 wherein said support columns comprise a foam base member positioned between said playing surface and said cover means and wherein said discs are rigid and are secured to said cover above said base member.

11. The game apparatus of claim 1 wherein said playing piece comprises a holder and at least one roller bearing mounted in said holder, said holder being of a height substantially equal to said predetermined distance.

12. The game apparatus of claim 1 including peripheral wall means around said playing surface for confining said playing piece.

13. The game apparatus of claim 12 wherein said wall means is of irregular shape for deflecting said playing piece propelled against said wall means.

14. The game apparatus of claim 12 including at least one recess defined in said wall means forming a goal for receiving said playing piece.

15. The game apparatus of claim 14 including a bell positioned in at least one of said goals for engagement by said playing piece to audibly indicate a score.

16. A game apparatus comprising:

a planar member defining a playing surface including at least one goal;

a transparent, flexible cover secured to said surface substantially parallel to said playing surface;

at least one flexible support member supporting said cover a preselected distance from said playing surface; and a rolling game object positioned on said playing surface between said playing surface and said cover.

17. The game apparatus claimed in claim 16 wherein said support member includes a flexible base member fabricated from a foam material, said base member being secured to said playing surface and positioned between said playing surface and said cover.

18. The game apparatus claimed in claim 17 wherein said support member further includes a pressure member secured to said cover adjacent said base member.

19. The game apparatus claimed in claim 16 wherein said game object includes vertically stacked first and second bearings such that the outer periphery of each bearing rollingly engages one of said playing surface and said cover.

* * * * *